US011709033B1

(12) United States Patent
Preston

(10) Patent No.: US 11,709,033 B1
(45) **Date of Patent: *Jul. 25, 2023**

(54) HANDGUN SAFETY AND RETENTION DEVICE

(71) Applicant: Charles Leon Preston, Huntsville, AL (US)

(72) Inventor: Charles Leon Preston, Huntsville, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/696,846

(22) Filed: Mar. 16, 2022

Related U.S. Application Data

(63) Continuation of application No. 17/092,170, filed on Nov. 6, 2020, now Pat. No. 11,320,236.

(60) Provisional application No. 62/933,061, filed on Nov. 8, 2019.

(51) Int. Cl.
*F41C 33/02* (2006.01)
*F41C 33/04* (2006.01)

(52) U.S. Cl.
CPC ..... *F41C 33/0245* (2013.01); *F41C 33/043* (2013.01)

(58) Field of Classification Search
CPC .. F41C 33/02; F41C 33/0245; F41C 33/0236; F41C 33/0263; F41C 33/043; F41A 17/54
See application file for complete search history.

(56) References Cited

U.S. PATENT DOCUMENTS

| | | | | |
|---|---|---|---|---|
| 4,945,665 | A * | 8/1990 | Nelson | F41A 17/54 42/70.07 |
| 10,132,585 | B2 * | 11/2018 | Harper | F41A 17/54 |
| 11,047,638 | B1 * | 6/2021 | Xu | F41G 1/35 |
| 11,320,236 | B1 | 5/2022 | Preston | |
| 2012/0286005 | A1 * | 11/2012 | Farnlach | F41C 33/0245 224/244 |
| 2015/0377585 | A1 * | 12/2015 | Fowler | F41C 33/0236 224/271 |
| 2016/0341519 | A1 * | 11/2016 | Gaiser | F41C 33/0245 |

OTHER PUBLICATIONS

Lucas, "Kydex "Trigger Guard Only" Holsters", Triangle Tactical, URL: https://triangletactical.net/2014/02/20/kydex-trigger-guard-only-holsters/, Feb. 20, 2014.
Cook's Holsters, Inc., Inside Waist Band Trigger Guard Carry, www.cookholsters.com/inside-waist-band-trigger-guard-carry/.

* cited by examiner

*Primary Examiner* — Corey N Skurdal
(74) *Attorney, Agent, or Firm* — C. Brandon Browning; Ilya Mirov; Maynard Nexsen PC

(57) ABSTRACT

A safety and retention device is provided for a weapon. The device has a first section that operates as a trigger guard cover or shield and is adapted to fit closely and specifically on the trigger guard of the weapon. The second section of the device operates as a retention clip that is designed to maintain or hold the holster (and weapon) on an item of clothing worn by a user. The first section and the second section can be integrally formed such that the first section and the second section share a common base.

20 Claims, 11 Drawing Sheets

HANDGUN SAFETY AND RETENTION DEVICE

CROSS-REFERENCE TO RELATED APPLICATION

This application is a continuation of and claims priority to U.S. Nonprovisional application Ser. No. 17/092,170, titled "Handgun Safety and Retention Device," filed on Nov. 6, 2020, and U.S. Provisional Patent Application No. 62/933,061, titled "Handgun Safety and Retention Device," filed on Nov. 8, 2019, the entire contents of which are incorporated herein by reference in their entireties.

BACKGROUND

The present disclosure describes a device that can operate as a holster for a handgun that has a shield or cover for the trigger guard and trigger of the handgun and has a retention clip that permits the holster (and handgun) to be held by an item of clothing, such as a waistband of a pair of pants.

Some people may carry a handgun on their person by placing the handgun between their body and the waistband of an item of clothing (e.g., pants) worn by the person. Numerous problems can arise for a person carrying a handgun in such a manner. One problem is that the handgun is not in a secure position and may move (e.g., up-and-down or side-to-side) from its original position in response to movements of the person. In addition, the handgun may rotate during movement of the person such that the grip of the handgun is at a different location relative to the original location of the grip of the handgun when placed in the waistband. The movement or rotation of the handgun from its original position may result in discomfort for the person and/or may make it difficult for the person to quickly retrieve the handgun when needed. Another problem with carrying a handgun in a waistband of an item of clothing is that the trigger of the handgun is exposed when the person inserts the handgun in or removes the handgun from the waistband. The exposure of the trigger during the insertion or retrieval of the handgun may result in an accidental discharge of the handgun that can cause injury to people and/or damage to property. Therefore what is needed is a handgun safety and retention device that can hold a handgun securely in the waistband of an item of clothing while also shielding the trigger of the handgun during the insertion and retrieval of the handgun such that accidental discharges of the handgun can be avoided.

BRIEF DESCRIPTION OF THE DRAWINGS

The following detailed description of the present disclosure may be better understood, by way of example only, with reference to the following drawings. The elements of the drawings are not necessarily to scale relative to each other, emphasis being placed upon clearly illustrating the principles of the disclosure.

Wherever possible, the same reference numbers are used throughout the drawings to refer to the same or like parts.

DETAILED DESCRIPTION

Figure 1:
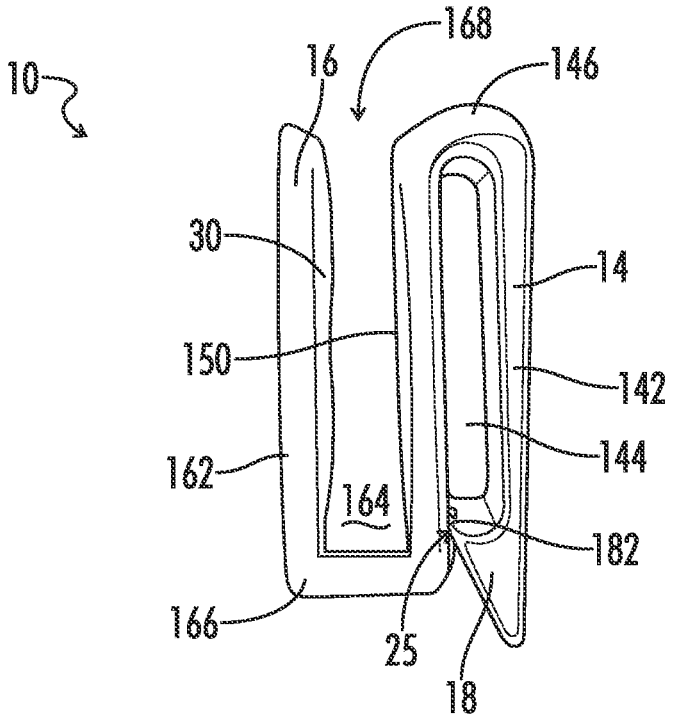
FIG. 1 shows a side view of an embodiment of a holster.
Figure 2:
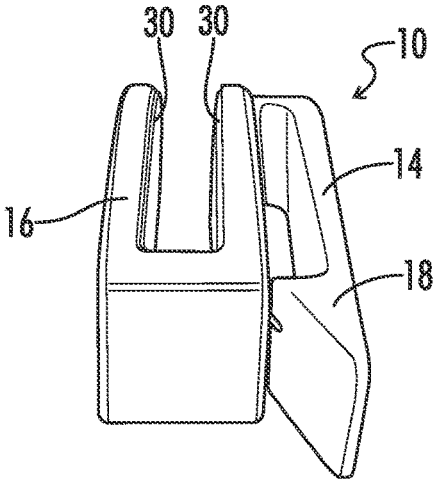
FIGS. 2-13 show different views of the holster of FIG. 1.
Figure 4:
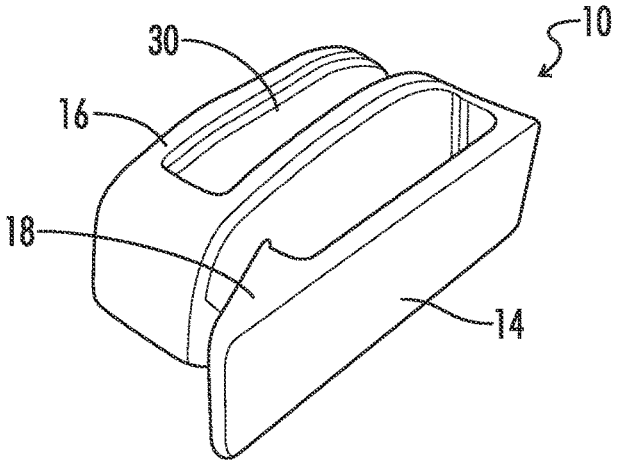
Figure 3:
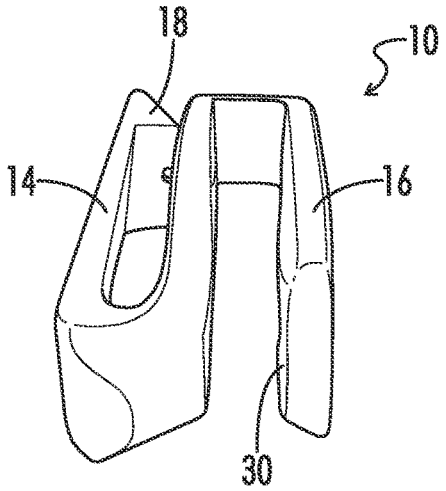
Figure 5:
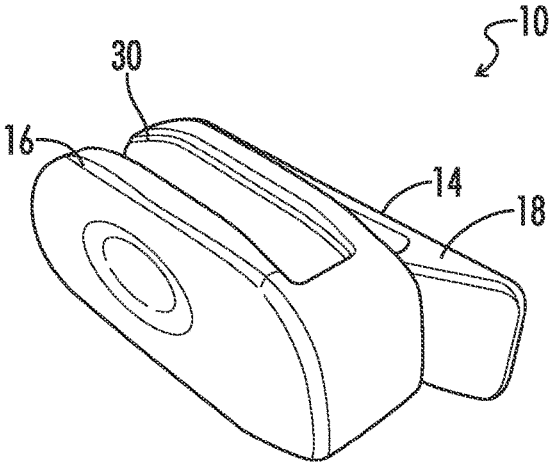
Figure 6:
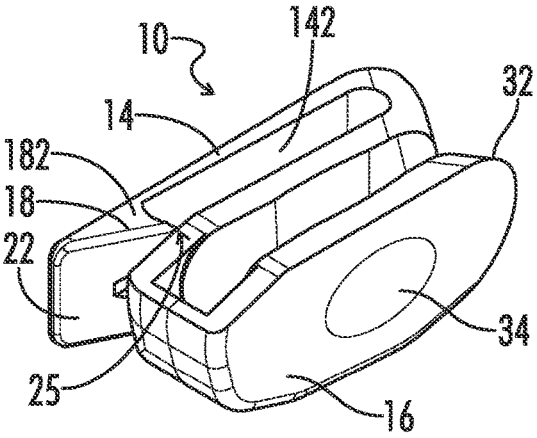
Figure 7:
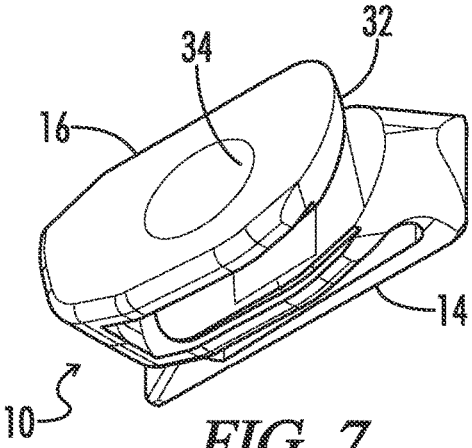
Figure 8:
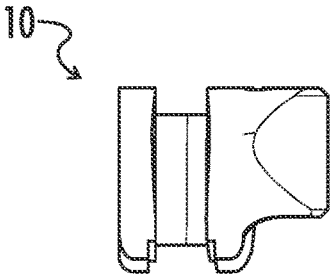
Figure 9:
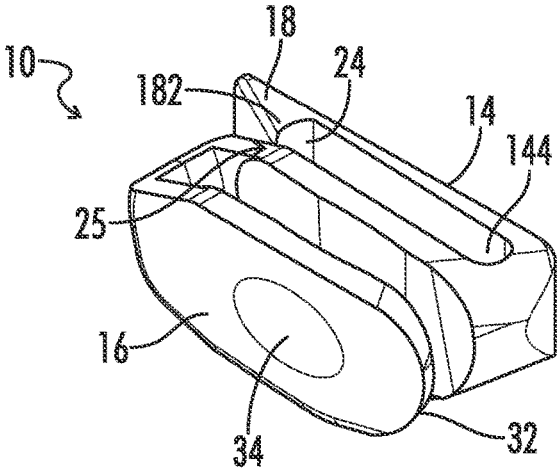

The present disclosure is directed to a holster for a weapon and methods of using the holster. As used herein, a "weapon" can be any firearm or triggered electroshock device designed or used to inflict physical damage or bodily harm. In one embodiment, the weapon can be a handgun. The holster is a minimalistic weapon safety and retention device that has two integral sections. One section of the holster operates as a trigger guard cover or shield that is adapted to fit closely and specifically on the trigger guard of the weapon in order to prevent access to the trigger so as to avoid accidental or inadvertent operation of the trigger. The other section of the holster operates as a retention clip that is designed to maintain or hold the holster (and weapon) on an item of clothing worn by a user. The retention clip can be used to position and hold the holster (and weapon) between an item of clothing worn by the user and the user's body such that at least a portion of the weapon may be concealed by the user's clothing. For example, the retention clip may be fastened to a belt and a waistband of an item of clothing, just the waistband (which may include a drawstring) of an item of clothing, or a pocket (or other area) of an item of clothing. The holster can be placed on the weapon, specifically on the trigger guard of the weapon, and then fastened or clipped onto the item of clothing worn by the user. The weapon can be removed from the holster (and the item of clothing) at will and with ease and without removing the holster from the item of clothing. In the event that the user would need to utilize the weapon, the user could grasp and pull on the handle of the weapon to remove the weapon from the holster, while the holster remains clipped to the item of clothing, and have full access to the trigger and the ability to discharge the weapon, if needed. After removing the weapon from the holster, the user would have to remove the holster from the item of clothing, re-mount the weapon in the holster and then re-attach the holster (with the weapon) to the item of clothing.

FIGS. 1-15 shows an embodiment of a holster for a weapon, such as a handgun, that can be attached to an item of clothing worn by a user and can provide a cover for the trigger and trigger guard when the weapon is holstered. The holster 10 can include a trigger guard shield 16 and a retention clip 14. In one embodiment, the dimensions of the holster 10 may vary with its intended compatible weapon. For example, a weapon with a large trigger well and trigger guard may be fitted with a holster 10 having a large trigger guard section 16, while a different weapon 12 with a small trigger well and trigger guard may be fitted with a holster having a small trigger guard section 16.

As shown in FIG. 1, the trigger guard shield 16 and the retention clip 14 are formed from a single, integral piece of material. However, in other embodiments, the trigger guard shield 16 and retention clip 14 may be separate components that can be connected together by chemical techniques (e.g., epoxy) or mechanical techniques (e.g., fasteners). In an embodiment, the holster 10 is created from a filament of nylon polymer impregnated with carbon fiber. However, in other embodiments, the holster may be from other suitable materials such as other polymers, plastics or ceramics. In a further embodiment, the holster may be manufactured using additive manufacturing (or 3D printing). However, other suitable manufacturing techniques (e.g., injection molding) may be used in other embodiments.

The trigger guard shield 16 has a base portion 150 and a shield portion 162 on opposed sides of a cavity 164. In one embodiment, the base portion 150 and shield portion 162 can each have one or more substantially planar surfaces. The shield portion 162 can have a geometric shape (e.g., an oval or quadrilateral shape) such that the shield portion 162 has a shape similar to the trigger guard of a weapon and can prevent access to the trigger and trigger well of the weapon. In an embodiment, the base portion 150 may have a shape that is substantially similar to the shape of the shield portion 162 such that both sides of the trigger guard can be covered to prevent access to the trigger and trigger well of the weapon. The cavity 164 can be closed on one end by a connecting portion 166 that connects the base portion 150 and the shield portion 162. The connecting portion 166 can be substantially perpendicular to both the base portion 150 and the shield portion 162 and may be angled to match a corresponding angled portion of the trigger guard.

In one embodiment, the connecting portion 166 can connect the shield portion 162 to the base portion 150 such that the shield portion 162 is positioned at an angle with respect to the base portion 150. The shield portion 162 can be angled with respect to the base portion 150 such that the shield portion 162 (and the base portion 150) can form a frictional connection with a trigger guard of a weapon (and possibly a portion of the weapon) in order to hold the weapon in the holster 10. The tolerances of the frictional connection determine the force needed to remove the holster 10 from the weapon, or the weapon from the holster 10.

The trigger guard shield 16 may have an opening 168 to receive a trigger guard of a weapon. The opening 168 can be located opposite the connecting portion 166 and between the base portion 150 and the shield portion 162. The opening 168 can extend along one or more edges of the base portion 150 and the shield portion 162 toward the connecting portion 166. For example, if the base portion 150 and the shield portion 162 have a rectangular shape, the opening 168 can extend along 3 sides of the rectangular shape with the connecting portion 166 being located at the fourth side.

The retention clip 14 shares the base portion 150 with the trigger guard shield 16. The retention clip 14 also has a retention portion 142 separated from the base portion 150 by a cavity 144. In one embodiment, the base portion 150 and retention portion 142 can each have one or more substantially planar surfaces. In one embodiment, the retention portion 142 can have a position such that the retention portion 142 is centered with respect to the base portion 150. However, in other embodiments, the retention portion 142 may be offset relative to the base portion 150 such that an edge of the retention portion may be in alignment with an edge of the base portion 150.

The retention portion 142 can have a geometric shape (e.g., a rectangular shape) such that the retention portion 142 is unobtrusive to the user. In one embodiment, the retention portion 142 may have dimensions such that the holster 10 containing a weapon is sufficiently secure when clipped on a belt and/or waistband of an item of clothing. The retention portion 142 may have a similar shape to the base portion 150 in one embodiment, but may have a significantly different shape from the base portion 150 in other embodiments. The cavity 144 can be closed on one end by a connecting portion 146 that connects the base portion 150 and the retention portion 142. The connecting portion 146 can be substantially perpendicular to both the base portion 150 and the retention portion 142. In one embodiment, the cavity 144 may be smaller in size than the cavity 164. However, in other embodiments, the cavity 144 may be larger or approximately the same as cavity 164.

In an embodiment, the connecting portion 146 can connect the retention portion 142 to the base portion 150 such that the retention portion 142 is positioned at an angle with respect to the base portion 150. The retention portion 142 can be angled with respect to the base portion 150 such that the retention portion 142 (and base portion 150) can form a frictional connection with a belt and/or waistband of an item of clothing worn by the user in order to hold the holster 10 in position on the belt and/or waistband.

The retention clip 14 may include an end portion 18 at an end of the retention portion 142 opposite the connecting portion 146. The end portion 18 can have one or more retention teeth 182 extending toward (and possibly be in contract with) the base portion 150. The end portion 18 can be integral with the retention portion 142 such that the end portion 18 and the retention portion 142 form a unitary structure. The retention teeth 182 can be used to engage with and frictionally connect to the belt and/or the waistband of the item of clothing when the holster 10 is placed on the item of clothing. The retention teeth 182 can be used to hold the holster 10 in position on the belt and/or the waistband when the person withdraws the weapon from the holster 10. The end portion 18 of the retention portion 142 can be pivoted (or moved) away from the base portion 150 to increase the spaced between the retention teeth 182 and the base portion 150 to permit the holster 10 to be more easily attached to the belt and/or waistband or removed from the belt and/or waistband of the item of clothing by the user. In addition, the retention clip 14 may have openings to the cavity 144 located along one or more edges of the base portion 150 and the retention portion 142 to permit the belt or waistband of the user to pass through the retention clip 14.

In the embodiment shown in FIGS. 6, 9, 10, 12 and 14, the retention teeth 182 may each have a sloped external surface 22 extending from the end of the end portion 18 and terminating in an edge portion 25. The sloped external surface 22 of the retention teeth 182 can enable a material (e.g., a belt and/or waistband) to be easily introduced into retention clip 14 by gliding over the retention teeth 182 and passing into cavity 144 between retention portion 142 and the base portion 150. The path of the material along the sloped external surface 22 prevents or reduces the escape of the material from retention clip 14 of holster 10. Each of the retention teeth 182 can have a concave interior surface 24 extending between the edge portion 25 and the retention portion 142. The concave interior surface 24 of the retention teeth 182 can be used to slow and trap the material in a binding fashion to hold the holster 10 in place on the belt and/or waistband of the item of clothing. The edge portion 25 can grab onto the material and stop the material from leaving retention clip 14 of holster 10 by holding the material against the base portion 150.

Figure 10:
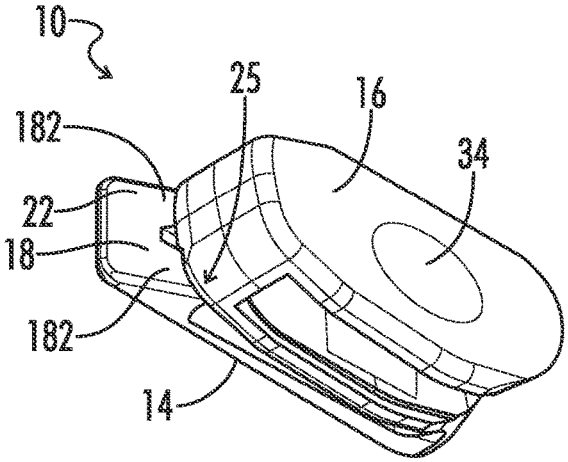
Figure 11:
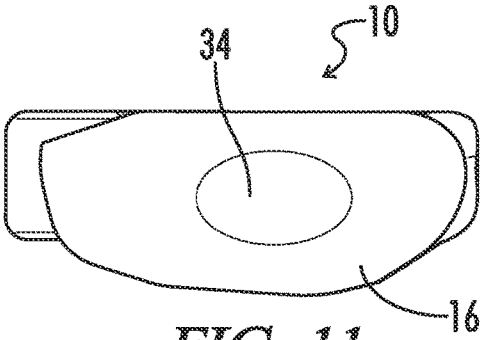
Figure 12:
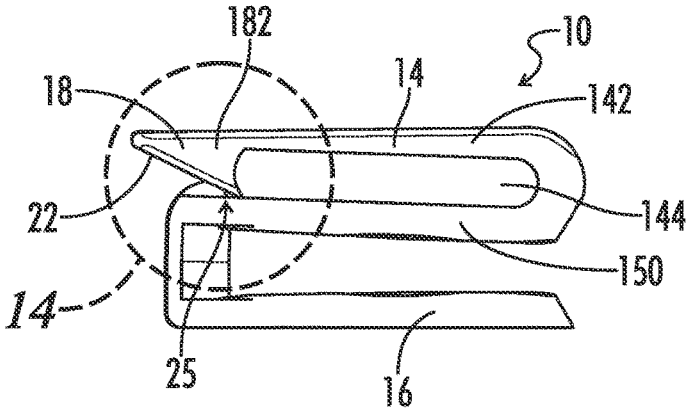
Figure 13:
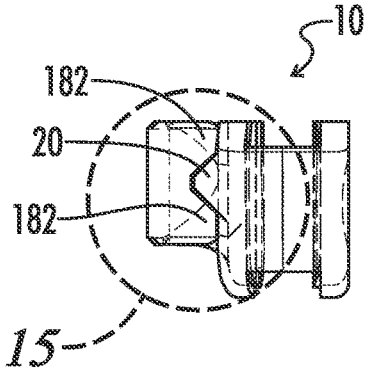
Figure 14:
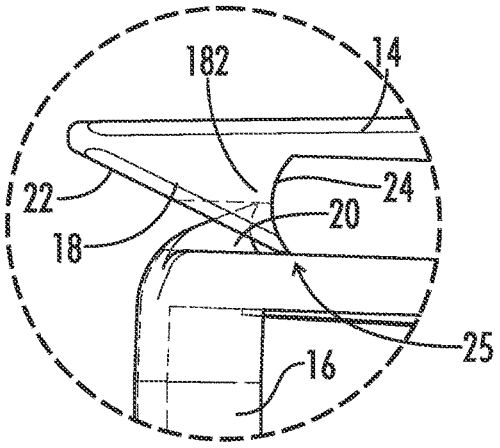
FIG. 14 shows an enlarged view of detail A from FIG. 12.
Figure 15:
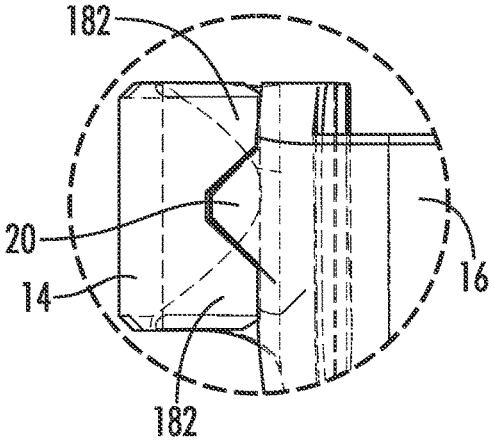
FIG. 15 shows an enlarged view of detail B from FIG. 13.

In one embodiment as shown in FIGS. 10, 13 and 15, the end portion 18 may have two retention teeth 182 separated by a gap or opening in the sloped external surface 22. Each of the retention teeth 182 may have a shape similar to a pyramid that extends from the retention portion 142 and ends in a point at the edge portion 25. In other embodiments, the retention teeth 182 may have other three-dimensional shapes that end in points or corners at the edge portion 25. Between the two retention teeth 182 may be a singular tooth 20 on the base portion 150 that is smaller than the retention teeth 182 in one embodiment. In an embodiment, the singular tooth 20 may have a pyramid shape, but may have different shapes in other embodiments. The arrangement of the two retention teeth 182 and the singular tooth 20 can create a chicane-like or S-curved path for the material (e.g., the belt or waistband of the user) to be enclosed between the teeth. The curved path traveled by the material prevents or reduces the escape of the material from retention clip 14 of holster 10 such that the material is held between retention teeth 182 and singular tooth 20. In addition, the material is also slowed and trapped in a binding fashion on the concave interior surface 24 of the retention teeth 182. The dimensions of the retention teeth 182 can scale with the size of the singular tooth 20, so that the singular tooth 20 splits the two retention teeth 182 and the singular tooth 20 and the retention teeth 182 span approximately the width of end portion 18.

As shown in FIGS. 1, 2, 4-6, and 10-12, the retention clip 14 extends lengthwise beyond trigger guard section 16 such that the end portion 18 extends past the connecting portion 166. However, in other embodiments, the retention clip 14 may not extend beyond trigger guard section 16. The thicknesses of retention clip 14 (i.e., the distance between the outer surface of retention portion 142 and the inner surface of retention portion 142) and trigger guard section 16 (i.e., the distance between the outer surface of shield portion 162 and the inner surface of shield portion 162) are approximately equal in one embodiment. However, in other embodiments, the retention clip 14 and the trigger guard shield 16 may have different thicknesses.

In one embodiment, as shown in FIGS. 1-5, the inner surface of shield portion 162 (i.e., the surface of the shield portion 162 adjacent to the cavity 166) and the inner surface of base portion 150 (i.e., the surface of the base portion 150 adjacent to the cavity 166) can be extruded to form a raised portion 30 that is smaller in area than the corresponding shield portion 162 or the corresponding base portion 150. The raised portion 30 from each of the shield portion 162 and the base portion 150 can extend into the trigger well (i.e., the area inside the trigger guard that includes the trigger) when the holster 10 is mounted on a weapon. The raised portion 30 can be shaped or include dimensions that substantially match the interior dimensions of the trigger well. Thus, when the holster 10 is mounted on a weapon, the raised portion 30 prevents the holster 10 from being rotated clockwise or counterclockwise relative to the weapon 12. Additionally, the front portion of trigger guard section 16 includes a beveled surface 32 (see FIGS. 6, 7 and 9) so as to not interfere with access and the forces required to extract the weapon from the holster 10. In addition, beveled surface 32 can also have a shape that tracks the grip of the weapon and/or does not interfere with the magazine release button of the weapon.

Figure 16:
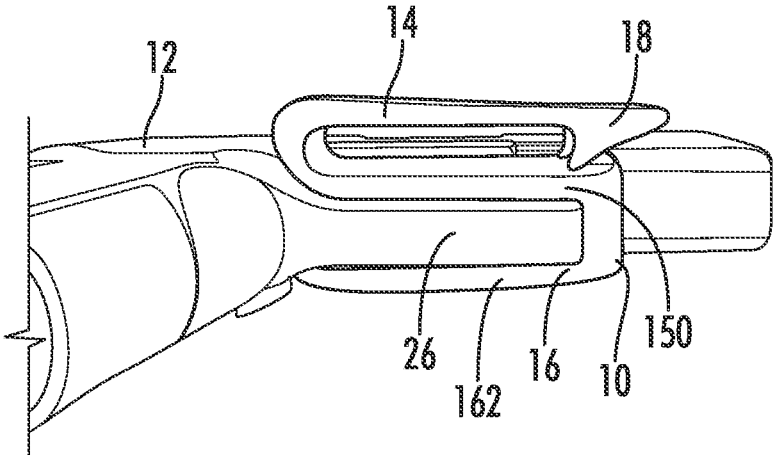
FIGS. 16-18 show a weapon mounted in the holster of FIG. 1.
Figure 17:
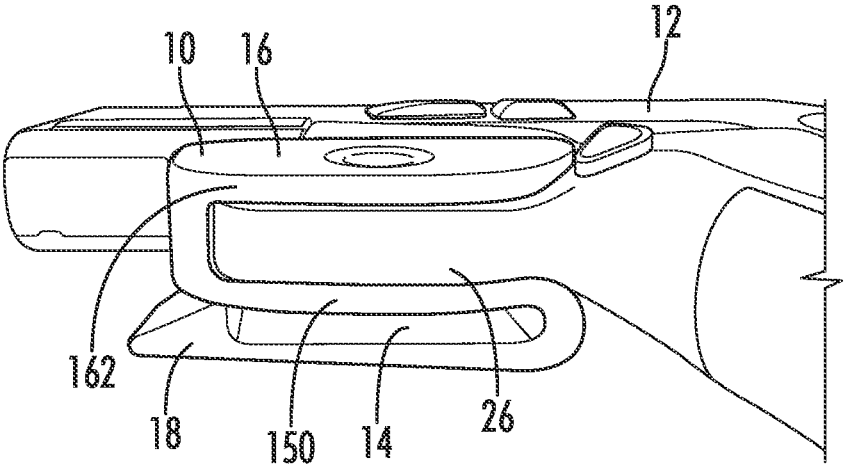
Figure 18:
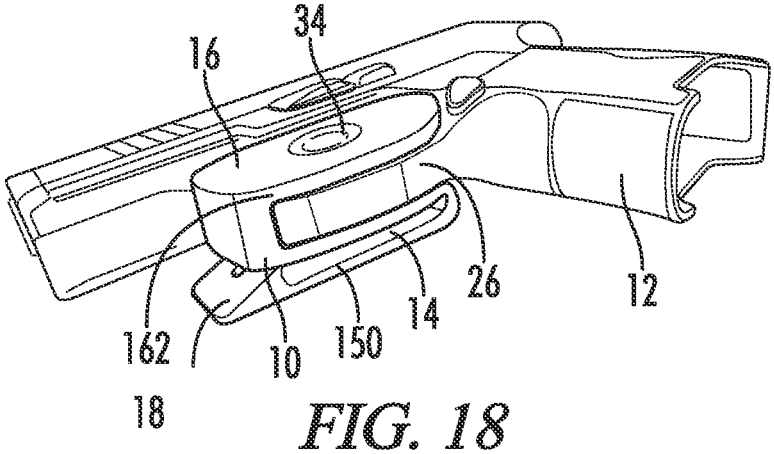
Figure 19:
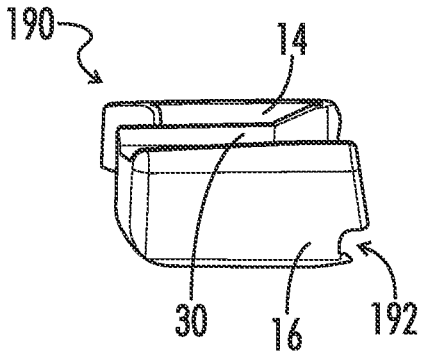
FIGS. 19 and 20 show different views of another embodiment of a holster.

FIGS. 16-18 show a weapon 12 mounted in the holster 10 of FIG. 1. Under normal operation, holster 10 is configured to be placed on weapon 12 and still permit the user to perform all functional operations of the weapon 12, with the sole exception of the depressing of the trigger. For example, a user can insert and release the magazine, charge the slide, lock the slide, operate any safety switches, and load and unload the weapon 12 while the trigger is secured in a safe manner by holster 10. As shown in FIGS. 16-18, the trigger guard section 16 forms a frictional connection with the trigger guard 26 to hold the holster 10 in place on the weapon 12. The shield portion 162 and the base portion 150 can have a size and shape such that the trigger well (i.e., the space within the trigger guard 26 and including the trigger) is covered on one side by the shield portion 162 and on the other side by the base portion 150. The holster 10 can be mounted on either the left or right side of weapon 12, depending on the user's preferences (such as right-hand draw or left-hand draw). As shown in FIG. 18, the outer surface of the shield portion 162 has a small oval indexing depression 34 that permits the user to properly identify and index the trigger's location prior to drawing weapon 12.

Figure 20:
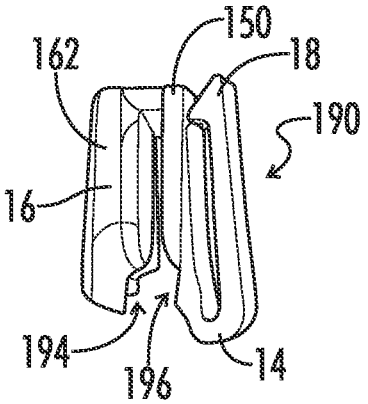
Figure 21:
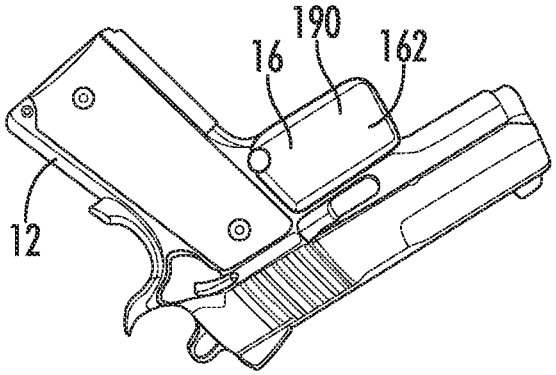
FIGS. 21-24 show a weapon mounted in the holster of FIG. 19.
Figure 22:
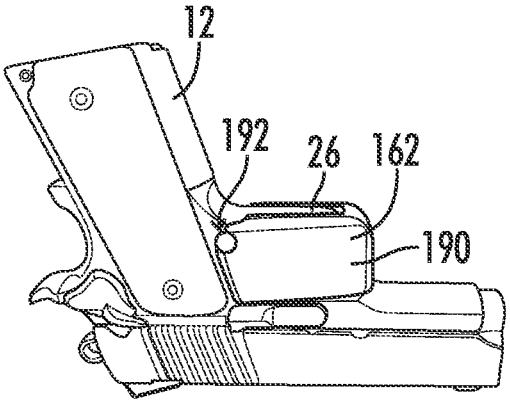
Figure 23:
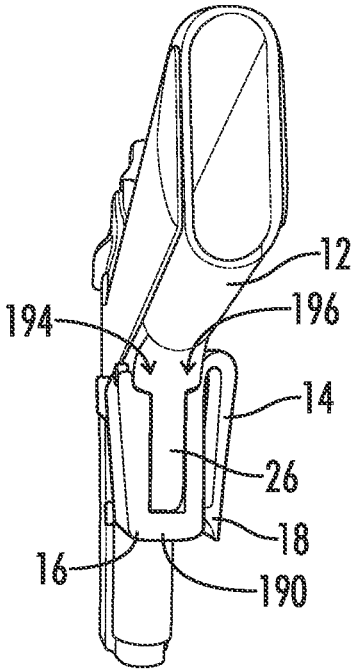
Figure 24:
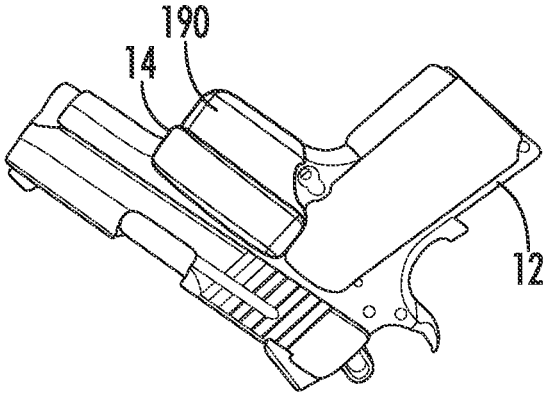
Figure 25:
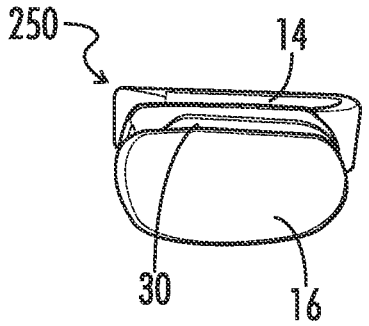
FIGS. 25 and 26 show different views of a further embodiment of a holster.

FIGS. 19-24 show another embodiment of the holster. The holster 190 of FIG. 19 can incorporate many of the same features as is found in the holster 10 previously described with respect to FIGS. 1-15. One difference, between holster 190 and holster 10 is that the holster 190 has a cutout 192 in the shield portion 162 that permits the shield portion 162 to fit around the magazine release button of the weapon 12. As shown in FIG. 22, the cutout 192 enables the shield portion 162 to "go around" the magazine release button to permit the shield portion 162 to cover the entire trigger well. If cutout 192 were not present in the shield portion 162, the magazine release button would interfere with the shield portion 162 covering the trigger well. In addition, as shown in FIG. 20, holster 190 can also include a step portion 194 on the interior surface of the shield portion 162 and a step portion 196 on the interior portion of the base portion 150. The step portions 194 and 196 permit the shield portion 162 and the base portion 150 to be positioned on a portion of the grip of the weapon 12 as shown in FIG. 23 such that the trigger well can be covered by the shield portion 162 and the base portion 150.

Figure 26:
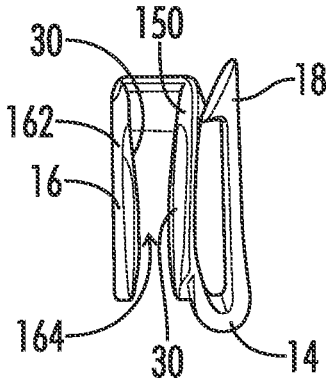
Figure 27:
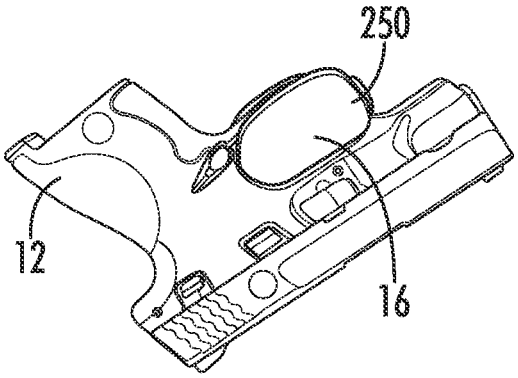
FIGS. 27-30 show a weapon mounted in the holster of FIG. 25.
Figure 28:
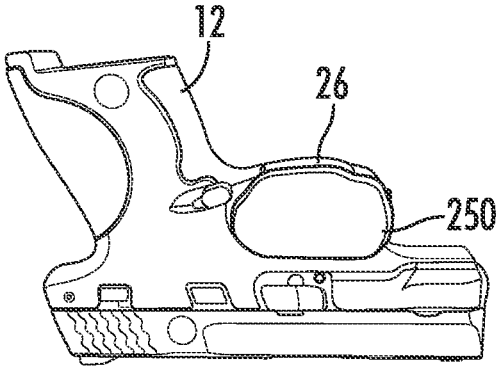
Figure 29:
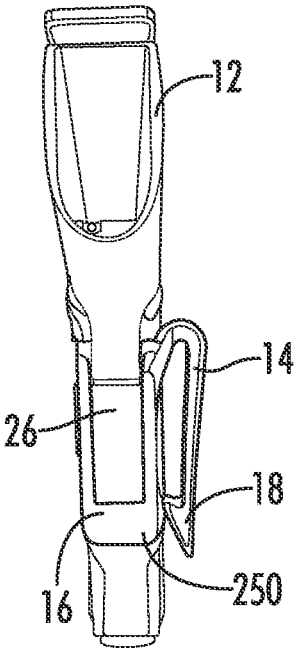
Figure 30:
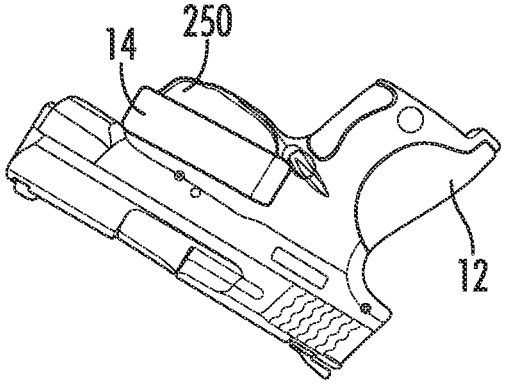
Figure 31:
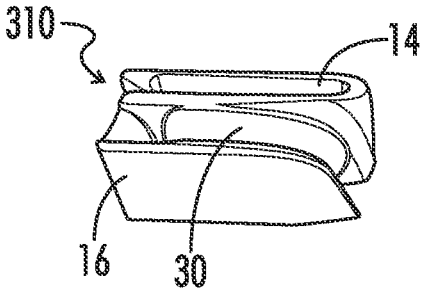
FIGS. 31 and 32 show different views of another embodiment of a holster.

FIGS. 25-30 show a further embodiment of the holster. The holster 250 of FIG. 25 can incorporate many of the same features as is found in the holster 10 previously described with respect to FIGS. 1-15. One difference, as shown in FIG. 26, between holster 250 and holster 10 is that the raised portion 30 on the inner surface of the shield portion 162 of the holster 250 and the raised portion 30 on the inner surface of the base portion 150 of the holster 250 each extend further into cavity 164 then the raised portions 30 of holster 10. The increased height of the raised portion 30 (relative to either the shield portion 162 or the base portion 150) enables the holster 250 to more snugly fit in the trigger well and prevent rotation of the weapon 12 relative to the holster 250.

Figure 32:
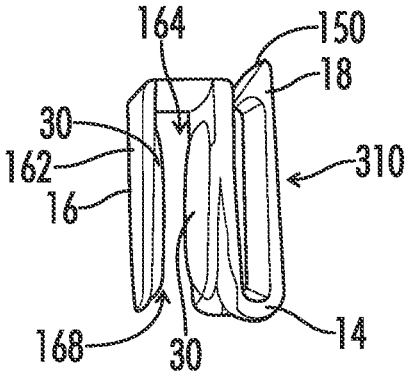
Figure 33:
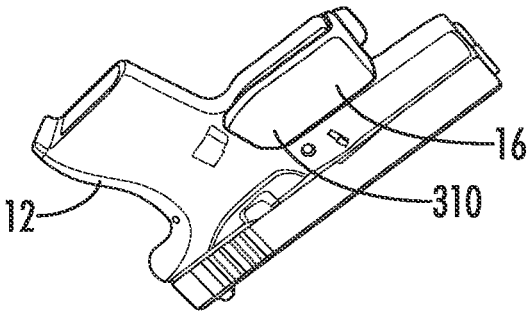
FIGS. 33-36 show a weapon mounted in the holster of FIG. 31.
Figure 34:
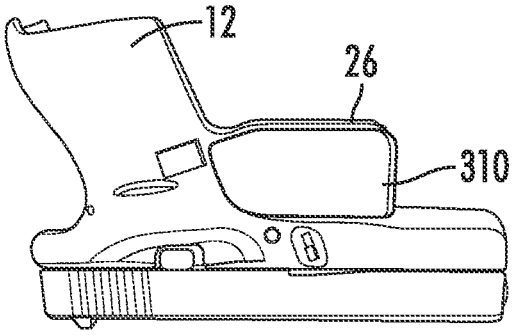
Figure 35:
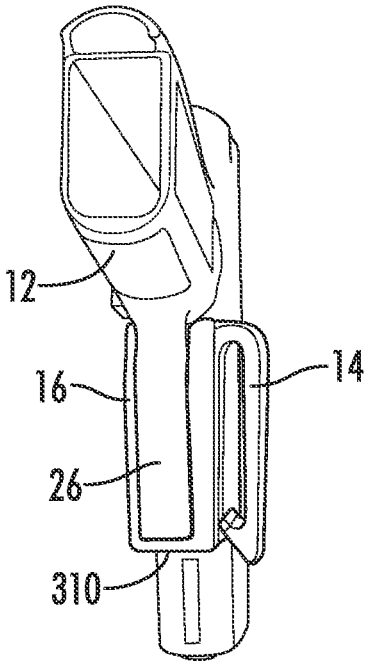
Figure 36:
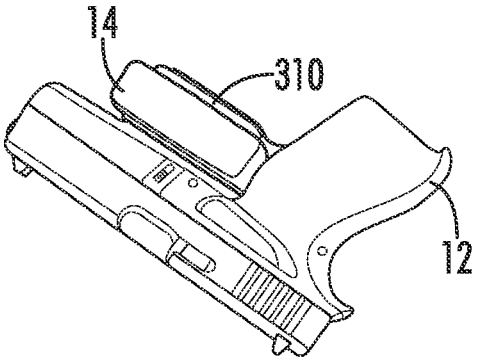

FIGS. 31-36 show still another embodiment of the holster. The holster 310 of FIG. 31 can incorporate many of the same features as is found in the holster 10 previously described with respect to FIGS. 1-15. One difference, as shown in FIG. 32, between holster 310 and holster 10 is that the raised portion 30 on the inner surface of the shield portion 162 of the holster 310 and the raised portion 30 on the inner surface of the base portion 150 of the holster 310 each have a sloped surface extending between an end of the raised portion 30 near connection 166 and an end of the raised portion 30 near the opening 168 to cavity 164. In other words, the height of the raised portion 30 (relative to either the shield portion 162 or the base portion 150) at the end near connection 166 is less than the height of the raised portion 30 at the end near opening 168. The sloped surface of the raised portion 30

(relative to either the shield portion 162 or the base portion 150) enables the holster 310 to more snugly fit in the trigger well and prevent rotation of the weapon 12 relative to the holster 310.

In another embodiment, the raised portion 30 on the inner surface of the shield portion 162 and the raised portion 30 on the inner surface of the base portion 150 each can have a sloped surface extending between one side of the raised portion 30 and the opposed side of the raised portion 30 (in contrast to the sloped surface of the raised portion 30 extending between ends of the raised portion 30). In another embodiment, one or more sides of the raised portion 30 on the inner surface of the shield portion 162 and one or more sides of the raised portion 30 on the inner surface of the base portion 150 can have a beveled edge that permits the trigger guard section 16 to more easily slide over the trigger guard 26 when positioning the holster 10 on the weapon 12 by moving the holster 10 toward the barrel of the weapon (in contrast to positioning the holster 10 on the weapon 12 by moving the holster along the barrel of the weapon 12). In a further embodiment, the raised portion 30 on the inner surface of the shield portion 162 and the raised portion 30 on the inner surface of the base portion 150 can each have a cut-out section with a shape similar to the trigger of the weapon 12. The presence of the cut-out section in the raised portion 30 can minimize the presence of frictional forces on the trigger of the weapon 12 when positioning the holster 10 on the weapon 12.

Figure 37:
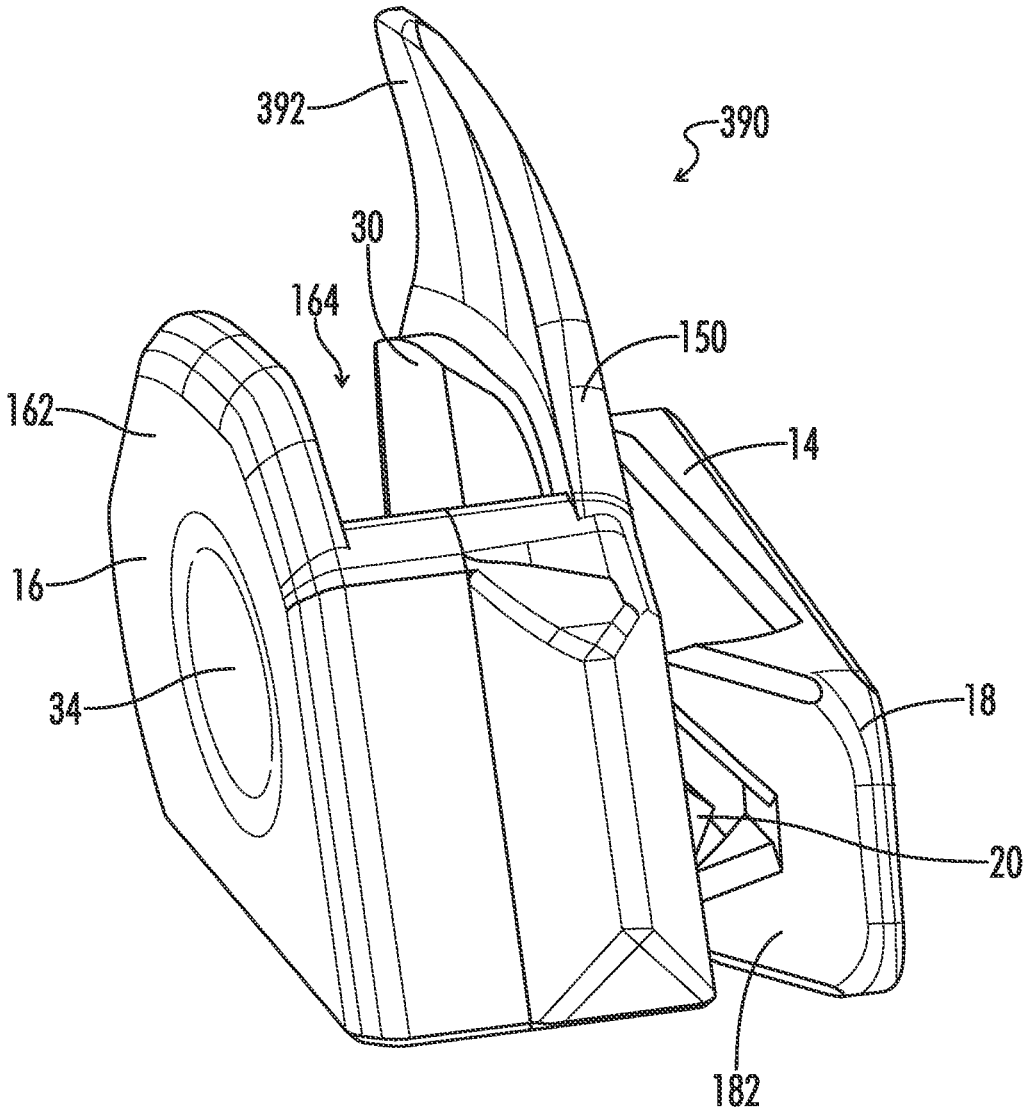
FIG. 37 shows an end view of still another embodiment of a holster.

In still another embodiment as shown in FIG. 37, the base portion 150 can have an extension portion 392 that extends from one side of the base portion 150 such that the shield portion 162 and the base portion 150 have different shapes. The extension portion 392 can have a "shark-fin" shape in one embodiment, but may have other shapes in other embodiments. In addition, the extension portion 392 may have a shape that curves toward cavity 164 and can reduce the possibility of the trigger guard shield 16 and trigger guard 26 of the weapon 12 snagging on the user's clothing when the user is attaching the holster 10 and weapon 12 to the belt and/or waistband of the item of clothing. In a further embodiment, the shield portion 162 may have an extension portion 392 in addition to or in place of the extension portion 392 on the base portion 150.

Figure 38:
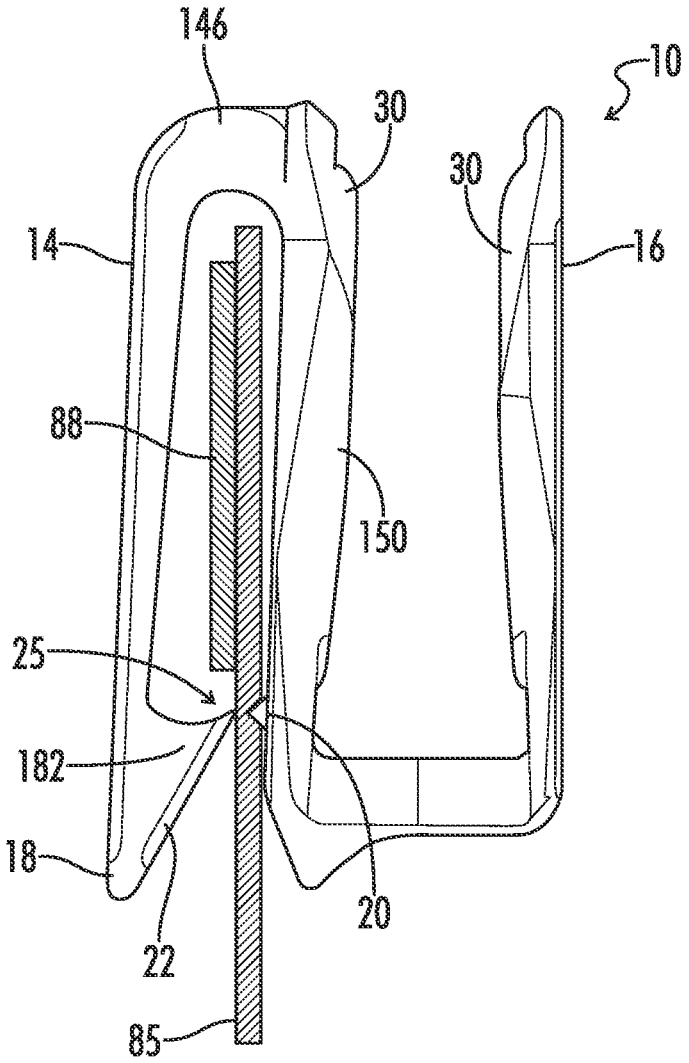
FIG. 38 shows a side view of an embodiment of a holster attached to an item of clothing.
Figure 39:
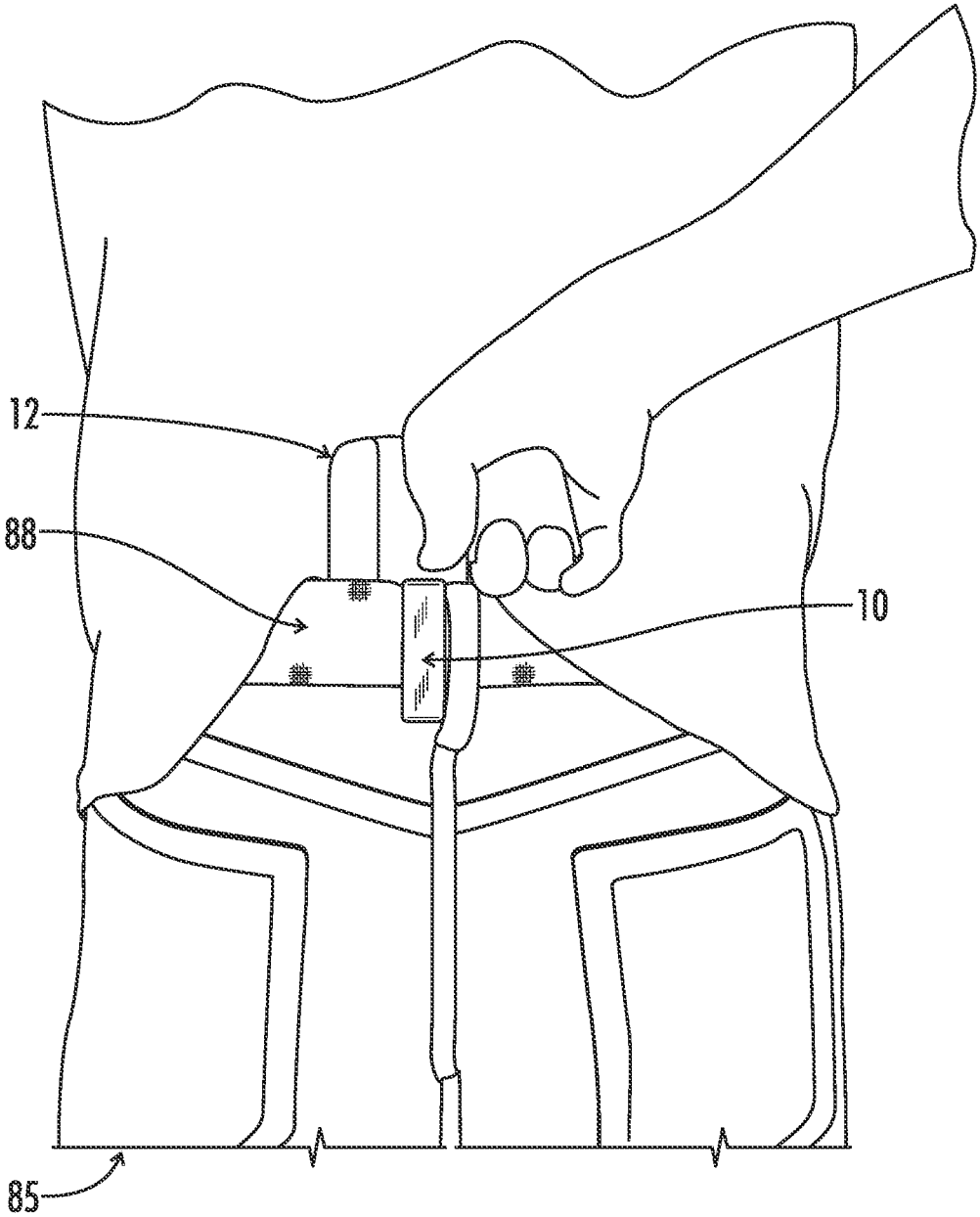
FIG. 39 shows a weapon mounted in an embodiment of a holster attached to an item of clothing.

FIGS. 38 and 39 show the holster 10 secured on an item (or piece) of clothing. FIG. 38 shows a side view of an embodiment of the holster 10 secured on item of clothing. As discussed above, the polymer construction of the holster 10 introduces some flexibility in holster 10 at the most distal portion where retention teeth 182 and trigger guard tooth 20 are located. The flexibility is provided from the connecting portion 146 having some elasticity to permit the end portion 18 to be moved away from the base portion 150. A user can introduce a waistband 85 of an item of clothing with a belt 88 or drawstring and the distal portion of retention clip 14 will flex, allowing retention teeth 182 and trigger guard tooth 20 to spread as the waistband 85 and belt 88 travel along sloped external surface 22 until the waistband 85 and belt 88 are fully seated in retention clip 14 as shown in FIG. 38. From this position, weapon 12 and holster 10 can be removed from the material at the same time by pulling laterally on holster 10 and rotating weapon 12 and holster 10 as one unit until both slide off of the material 85 and belt 88. Alternatively, weapon 12 can be removed without the removal of holster 10 by pulling on the handle (or grip) of weapon 12, allowing the retention teeth 182 and trigger guard tooth 20 of holster 10 to engage with the waistband 85 and for the holster 10 to maintain its secured position on the item of clothing. FIG. 39 shows the weapon 12 mounted in the holster 10 and the holster 10 attached to the belt 88 and waistband 85 of an item of clothing.

The foregoing is merely illustrative of the principles of this disclosure and various modifications may be made by those skilled in the art without departing from the scope of this disclosure. The above described embodiments are presented for purposes of illustration and not of limitation. The present disclosure also can take many forms other than those explicitly described herein. Accordingly, it is emphasized that this disclosure is not limited to the explicitly disclosed methods, systems, and apparatuses, but is intended to include variations to and modifications thereof, which are within the scope of the following claims.

As a further example, variations of apparatus or process parameters (e.g., dimensions, configurations, components, process step order, etc.) may be made to further optimize the provided structures, devices and methods, as shown and described herein. The structures and devices, as well as the associated methods, described herein have many applications. Therefore, the disclosed subject matter should not be limited to any single embodiment described herein, but rather should be construed in breadth and scope in accordance with the appended claims.

What is claimed is:

1. A holster for holding a weapon, comprising:

a first section configured for covering a trigger guard of a weapon, the first section including:

a first portion;

a second portion;

a third portion extending to and between the first portion and the second portion;

a first cavity defined at least in part by the first portion, the second portion and the third portion, the first cavity being configured for receiving the trigger guard with the first portion covering a first lateral side of the trigger guard, the second portion covering a second lateral side of the trigger guard and the third portion covering a front side of the trigger guard when the weapon is mounted in the holster; and a first raised portion extending from at least one of the first portion and the second portion into the first cavity, the first raised portion being configured to extend into a trigger well defined by the trigger guard; and a second section configured for retaining the holster on an item of clothing, the second section including:

the first portion;

a fourth portion coupled to the first portion;

a second cavity defined at least in part by the first portion and the fourth portion, the second cavity being configured for receiving the item of clothing when the holster is retained on the item of clothing; and a projection extending into the second cavity and configured for engaging the item of clothing when the item of clothing is retained by the holster.

2. The holster of claim 1, wherein the first raised portion has a contour that corresponds with a contour of the trigger wall.

3. The holster of claim 1, wherein the first raised portion is configured for preventing rotation of the weapon relative to the holster when the weapon is retained by the holster.

4. The holster of claim 1, wherein the first raised portion extends from the first portion and a second raised portion extends into the cavity from the second portion.

5. The holster of claim 1, wherein at least one of the first portion and the second portion has a shape similar to the trigger guard of the weapon.

6. The holster of claim 1, the third portion is substantially perpendicular to both the first portion and the second portion.

7. The holster of claim 1, wherein the projection extends from the fourth portion and is moveable away from the first portion.

8. The holster of claim 1, wherein the second portion is positioned at an angle relative to the first portion such that the first portion and the second portion form a frictional connection with the trigger guard of the weapon when the weapon is mounted in the holster.

9. The holster of claim 1, wherein the fourth portion is positioned at an angle to the first portion such that the projection contacts with the first portion.

10. The holster of claim 1, wherein the first raised portion has a sloped surface.

11. The holster of claim 1, wherein the fourth portion has a length greater than that of at least one of the first portion and the second portion.

12. The holster of claim 1, wherein the first section is integral with the second section to form a single, unitary structure.

13. A holster for holding a weapon, comprising:

a first section configured for covering a trigger guard of a weapon, the first section including:

a first portion;

a second portion coupled to the first portion;

a first cavity defined at least in part by the first portion and the second portion, the first cavity being configured for receiving the trigger guard with the first portion covering a first lateral side of the trigger guard and the second portion covering a second lateral side of the trigger guard when the weapon is mounted in the holster;

a first raised portion extending form the first portion into the first cavity, the first raised portion being configured to extend into a trigger well defined by the trigger guard;

a second raised portion extending from the second portion into the first cavity, the second raised portion being configured to extend into the trigger well; and a second section configured for retaining the holster on an item of clothing, the second section including:

the first portion;

a third portion coupled to the first portion;

a second cavity defined at least in part by the first portion and the third portion, the second cavity being configured for receiving the item of clothing when the holster is retained on the item of clothing; and a projection extending into the second cavity and configured for engaging the item of clothing when the item is retained by the holster.

14. The holster of claim 13, wherein each of the first raised portion and the second raised portion has a contour that corresponds with a contour of the trigger well.

15. The holster of claim 13, wherein at least one of the first portion and the second portion has a shape similar to the trigger guard of the weapon.

16. The holster of claim 13, wherein the projection extends from the third portion and the third portion is configured for flexing away from the first portion when the item of clothing is inserted into the second cavity.

17. The holster of claim 13, wherein the second portion is positioned at an angle relative to the first portion such that the first portion and the second portion form a frictional connection with the trigger guard of the weapon when the weapon is mounted in the holster.

18. The holster of claim 13, wherein the third portion has a length greater than that of at least one of the first portion and the second portion.

19. A holster holding a weapon, the holster comprising:

a first section covering a trigger guard of the weapon, the first section including:

a first portion covering a first lateral side of the trigger guard;

a second portion covering a second lateral of the trigger guard;

a third portion covering a front side of the trigger guard;

a first raised portion extending from the first portion into a trigger well defined by the trigger guard; and a second raised portion extending from the second portion into the trigger well; and a second section configured for retaining the holster on an item of clothing, the second section formed at least in part by the first portion, the second section including:

a cavity defined at least in part by the first portion; and a projection extending into the cavity and configured for engaging the item of clothing when the item is retained by the holster.

20. The holster of claim 19, wherein each of the first raised portion and the second raised portion has a contour that corresponds at least in part with a contour of the trigger well.

* * * * *